US009464856B2

(12) United States Patent
Lung et al.

(10) Patent No.: US 9,464,856 B2
(45) Date of Patent: Oct. 11, 2016

(54) CONFIGURABLE REMOTE WEAPON STATION HAVING UNDER ARMOR RELOAD

(71) Applicant: Moog Inc., East Aurora, NY (US)

(72) Inventors: Kevin Lung, Wadsworth, IL (US); Matthew Martinez, Bakersfield, CA (US); Frank Mueller, Santa Ynez, CA (US); David Rhodes, Solvang, CA (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 14/337,422

(22) Filed: Jul. 22, 2014

(65) Prior Publication Data

US 2016/0025435 A1 Jan. 28, 2016

(51) Int. Cl.

| | |
|---|---|
| ***F41A 9/29*** | (2006.01) |
| ***F41A 23/24*** | (2006.01) |
| ***F41A 9/57*** | (2006.01) |
| ***F41A 9/79*** | (2006.01) |
| ***F41A 27/08*** | (2006.01) |
| *F41H 7/04* | (2006.01) |
| *F41A 27/20* | (2006.01) |
| *F41A 27/24* | (2006.01) |

(52) U.S. Cl.

CPC .. *F41A 9/29* (2013.01); *F41A 9/57* (2013.01); *F41A 9/79* (2013.01); *F41A 23/24* (2013.01); *F41A 27/08* (2013.01); *F41A 27/20* (2013.01); *F41A 27/24* (2013.01); *F41H 7/04* (2013.01)

(58) Field of Classification Search

CPC ..... F41A 23/24; F41A 24/26; F41A 23/00; F41A 27/02; F41A 27/22; F41A 27/06; F41A 27/24; F41A 27/28; F41A 27/18; F41A 27/20; F41A 9/29; F41A 9/57; F41A 9/79

USPC ..... 89/37.01–37.04, 37.11–37.17, 41.01, 89/41.02

See application file for complete search history.

(56) References Cited

U.S. PATENT DOCUMENTS

| | | | | |
|---|---|---|---|---|
| 425,656 | A * | 4/1890 | Canet | 89/37.01 |
| 1,031,279 | A * | 7/1912 | Maxim | 89/41.16 |
| 1,742,436 | A * | 1/1930 | Dabrasky | 89/37.01 |
| 1,845,508 | A * | 2/1932 | Minshall | F41A 9/54 89/33.01 |
| 2,470,475 | A | 9/1945 | Diaper | |
| 2,519,129 | A | 8/1950 | Frise | |
| 2,520,736 | A | 8/1950 | Reek et al. | |
| 2,573,774 | A * | 11/1951 | Sandberg | 89/34 |
| 2,833,182 | A | 12/1955 | Houston et al. | |
| 2,960,009 | A * | 11/1960 | Hereth et al. | 89/1.805 |
| 4,144,797 | A | 3/1979 | Berge et al. | |
| 4,433,609 | A | 2/1984 | Darnall | |
| 4,574,685 | A * | 3/1986 | Sanborn | F41A 23/34 89/36.13 |
| 4,576,085 | A | 3/1986 | LeBlanc | |
| 5,056,409 | A | 10/1991 | Allais et al. | |
| 5,111,729 | A | 5/1992 | Tassie | |
| 5,419,234 | A * | 5/1995 | Sanderson | 89/37.22 |
| 6,286,411 | B1 | 9/2001 | Sanderson | |
| 6,439,098 | B1 * | 8/2002 | Dillon | 89/34 |
| 7,030,579 | B1 * | 4/2006 | Schmitz et al. | 318/139 |
| 7,047,863 | B2 * | 5/2006 | Hawkes et al. | 89/37.04 |
| 7,185,575 | B1 * | 3/2007 | Collier et al. | 89/1.8 |
| 7,600,462 | B2 | 10/2009 | Quinn | |

(Continued)

*Primary Examiner* — Joshua Freeman

(74) *Attorney, Agent, or Firm* — Hodgson Russ LLP

(57) ABSTRACT

An RWS is configurable to adjust the height of a rotational elevation axis thereof by providing interchangeable pairs of removably mounted yoke arms, wherein the pairs have different heights. The RWS is provided with at least one fixed hanging ammunition container that is reloadable under the armored protection of the vehicle and the RWS shell.

9 Claims, 18 Drawing Sheets

(56) References Cited

U.S. PATENT DOCUMENTS

| | | | | |
|---|---|---|---|---|
| 7,669,513 | B2 | 3/2010 | Niv et al. | |
| 7,798,050 | B2 | 9/2010 | Sembtner | |
| 7,908,957 | B1 * | 3/2011 | Leung | 89/33.14 |
| 8,215,225 | B1 * | 7/2012 | Zangrando | F41A 9/45 89/33.01 |
| 8,459,171 | B2 | 6/2013 | Cottle | |
| 8,646,374 | B2 | 2/2014 | Shacklee et al. | |
| 8,763,511 | B2 | 7/2014 | Schvartz et al. | |
| 8,910,559 | B1 * | 12/2014 | Berman | 89/36.08 |
| 2004/0050240 | A1 | 3/2004 | Greene et al. | |
| 2004/0134340 | A1 * | 7/2004 | Quinn | 89/41.01 |
| 2007/0119296 | A1 * | 5/2007 | Niv et al. | 89/37.02 |
| 2007/0209501 | A1 * | 9/2007 | Ko | 89/40.01 |
| 2007/0261544 | A1 * | 11/2007 | Philippe | 89/41.05 |
| 2008/0017426 | A1 | 1/2008 | Walters et al. | |
| 2008/0148931 | A1 | 6/2008 | Svensson et al. | |
| 2010/0126338 | A1 * | 5/2010 | Rastegar et al. | 89/37.13 |
| 2012/0024143 | A1 * | 2/2012 | Shacklee et al. | 89/41.02 |
| 2012/0186423 | A1 * | 7/2012 | Chachamian et al. | 89/33.01 |
| 2013/0000473 | A1 * | 1/2013 | Schvartz et al. | 89/33.2 |
| 2013/0068584 | A1 * | 3/2013 | Lim et al. | 192/103 R |
| 2013/0069581 | A1 * | 3/2013 | Lim et al. | 318/632 |
| 2013/0220109 | A1 * | 8/2013 | Berkovich | F41H 5/20 89/36.13 |
| 2013/0327205 | A1 * | 12/2013 | Mons et al. | 89/36.13 |
| 2015/0082977 | A1 * | 3/2015 | Tikochinski et al. | 89/41.01 |

* cited by examiner

CONFIGURABLE REMOTE WEAPON STATION HAVING UNDER ARMOR RELOAD

FIELD OF THE INVENTION

The present invention relates generally to the field of remote-controlled weapon stations or systems (RWSs), and more particularly to vehicle-mounted RWSs designed to mount over a hatch opening in a top deck of a vehicle.

BACKGROUND OF THE INVENTION

Vehicle-mounted RWSs are retrofittable to various types of military vehicles, including but not limited to armored combat vehicles (ACVs), mine-resistant ambush protected (MRAP) vehicles, armored multi-purpose vehicles (AMPVs), amphibious assault vehicles (AAVs), and light armored vehicles (LAVs). The RWS allows personnel to operate externally-mounted weapons from the within the armored protection of the vehicle.

An RWS may be outfitted with selected weapons (e.g. guns and missile launchers), and non-lethal operating units (e.g. target sighting units, acoustic hailers, and illuminators), to provide desired performance capabilities. Missile launchers suitable for use in an RWS include, without limitation, a Hellfire missile launcher, a Javelin missile launcher, and a TOW missile launcher. Automatic guns that process linked ammunition are favored in RWS configurations. Some of the guns falling into this category are the MK44 chain gun, CTAI 30 mm and 40 mm canons, the M242 chain gun, the M230LF autocannon, the M2 machine gun, the M3 submachine gun, the MK19 automatic grenade launcher, the M240 machine gun, the M249 light machine gun, and the M134 machine gun. Of course, an RWS may be outfitted with weapons and operating units other than those specifically mentioned above.

The linked ammunition typically comes in the form of a long ammunition belt held within an ammunition container. The belt extends out through an exit opening in the container to an ammunition feed mechanism at the gun. As an existing ammunition belt advances and is used up during firing, a leading link of a subsequent ammunition belt may be coupled to a trailing link of the existing belt to accomplish reloading. In some systems, the new belt is loaded into the existing container, while in other systems, the existing emptied container is removed and replaced with a new container holding the new belt.

One type of ammunition container designed to be reloaded when emptied is a hanging ammunition or suspended ammunition container. In this known arrangement, an ammunition belt is folded in serpentine fashion within the ammunition container, with upper links in the belt being supported by parallel rails at or near the top of the container so as to suspend or hang folded vertical segments of the belt in the container. This type of "hanging ammo" arrangement is described, for example, in U.S. Pat. No. 2,573,774 (Sandberg); U.S. Pat. No. 4,433,609 (Darnall); and U.S. Pat. No. 8,763,511 (Schvartz et al.).

In designing an RWS, it is desirable to provide personnel with the capability to reload the externally mounted automatic guns with linked ammunition while the personnel remain within the relatively safe confines of the armored vehicle. U.S. Patent Application Publication No. 2012/0186423 (Chachamian et al.) describes a system for protected reloading of an RWS. The system comprises an extendable and retractable support bracket having a top plate attached to the RWS and a bottom plate for receiving and supporting an ammunition container. The bottom plate is connected to the top plate by four gas pistons enabling the bottom plate carrying the ammunition box to be raised up into the RWS turret for regular use and lowered down into the vehicle compartment for reloading. While the system enables reloading under armored protection, it requires a mechanically complicated bracket and uses space within the vehicle compartment to accommodate the lowered ammunition container during reloading. Given that the vehicle compartment is already very confined, this solution is not optimal.

Another system for under armor reloading of ammunition is described in the aforementioned U.S. Pat. No. 8,763,511 (Schvartz et al.). The ammunition containers disclosed by Schvartz et al. are open at the front end and the rear end such that multiple containers may be stowed end-to-end in the RWS with their belts linked for regular use. An elevator mechanism is provided to lift ammunition containers from the vehicle compartment through a hatch and into the RWS. When a rearmost container is emptied, it is removed manually or using the elevator to make room for another container. Here again, the system enables reloading under armored protection, but it requires an elevator mechanism and uses valuable space within the vehicle compartment. The system also dedicates limited space within the RWS pedestal for multiple ammunition cans associated with only a single weapon.

With respect to weapons configuration, RWS design has been limited by a "point solution" mindset. In other words, RWSs are predominantly designed with a specific weapon configuration in mind. This mindset is understandable, given that the RWS must incorporate sophisticated motion drive and stabilization systems to rotate the RWS turret or pedestal about an azimuth axis, and to rotate a mounted weapon about an elevation axis, with precision and accuracy. By focusing on one or perhaps a few weapon configurations, RWS designers can limit the loading variables that must be accommodated and can optimize the weapon support and motion drive systems. However, this "point solution" mindset may be detrimental to combat preparedness because an RWS having a fixed weapon configuration may become ill-suited for combat as battle conditions change.

The height of the RWS elevation axis is an example of an RWS design parameter that limits the available weapon configurations. A relatively low elevation axis is useful for shorter barrel guns and gives the armored vehicle a desirably low profile. However, an RWS with a relatively low elevation axis cannot accommodate certain longer barrel guns and missile launchers. U.S. Pat. No. 7,669,513 (Niv et al.) teaches an RWS intended to have a variety of weapon configurations. The RWS has an automated vertically-adjustable linkage on which a weapon mount is carried for adjusting the height of the weapon elevation axis. This type of system introduces other costs, complexities, and possible malfunction points to the RWS.

What is needed is an RWS that enables reloading of ammunition under armor without using valuable space within the vehicle compartment and without relying on a conveyor mechanism.

What is also needed is a mechanically simple RWS that can be readily outfitted with a variety of weapon configurations depending upon changing combat requirements.

SUMMARY OF THE INVENTION

In an embodiment of the present invention, an RWS is configurable to adjust the height of a rotational elevation axis thereof by providing interchangeable pairs of removably mounted yoke arms, wherein the pairs have different heights.

The configurable RWS apparatus comprises a pedestal adapted to be mounted on an armored vehicle for rotation relative to the armored vehicle about an azimuth axis. The pedestal includes a pair of laterally-spaced yoke arm attachment interfaces. The RWS apparatus also comprises a first pair of elevation yoke arms and a second pair of elevation yoke arms selectively exchangeable with the first pair of elevation yoke arms in being removably mounted on the pedestal. The yoke arms are configured for removable mounting on the pair of yoke arm attachment interfaces of the pedestal for movement with the pedestal. A pair of elevation rotary bearings are respectively supported by the mounted pair of elevation yoke arms in alignment with one another to define the elevation axis. The RWS apparatus further comprises an elevation drive motor, and an elevation drive hub connected to the elevation drive motor and supported by one of the pair of elevation rotary bearings, wherein the elevation drive hub is rotatable about the elevation axis by operation of the elevation drive motor. An elevation follower hub is supported by the other of the pair of rotary bearings. The elevation drive hub and the elevation follower hub are configured for removable mounting of a primary weapon thereto such that the primary weapon resides between the mounted pair of elevation yoke arms and is rotatable about the elevation axis by operation of the elevation drive motor.

When the first pair of elevation yoke arms are mounted on the pedestal, they support the pair of elevation rotary bearings such that the elevation axis is at a first height above the pedestal. When the second pair of elevation yoke arms are mounted on the pedestal, they support the pair of elevation rotary bearings such that the elevation axis is at a second height above the pedestal different from the first height. Consequently, the elevation axis is height-adjustable for replacing a mounted primary weapon with a different primary weapon.

In another embodiment of the invention, an RWS is provided with at least one fixed hanging ammunition container that is reloadable under the armored protection of the vehicle and the RWS shell. The ammunition container has an ammunition storage portion and an ammunition exit chute leading from the storage portion, and the ammunition container is fixed to the pedestal such that the storage portion of the ammunition container resides at least mostly within, preferably completely within, an interior compartment defined by the pedestal. The exit chute of the ammunition container extends through the pedestal. A belt of linked ammunition suspended in the storage portion of the ammunition container is fed through the exit chute to supply a weapon carried by the external weapon support yoke. The fixed ammunition container is reloadable by personnel under protection of the armored vehicle and the pedestal.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
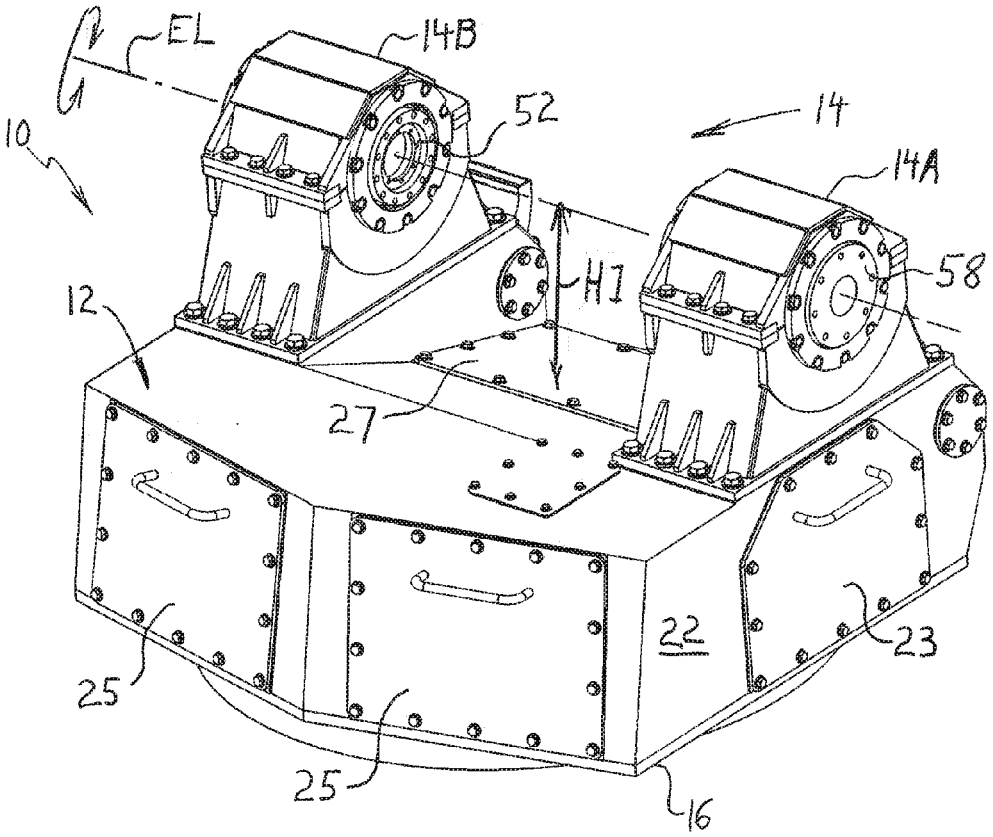
FIG. 1 is a perspective view of an RWS formed in accordance with an embodiment of the present invention, without any weapons or operational units installed thereon.
Figure 2:
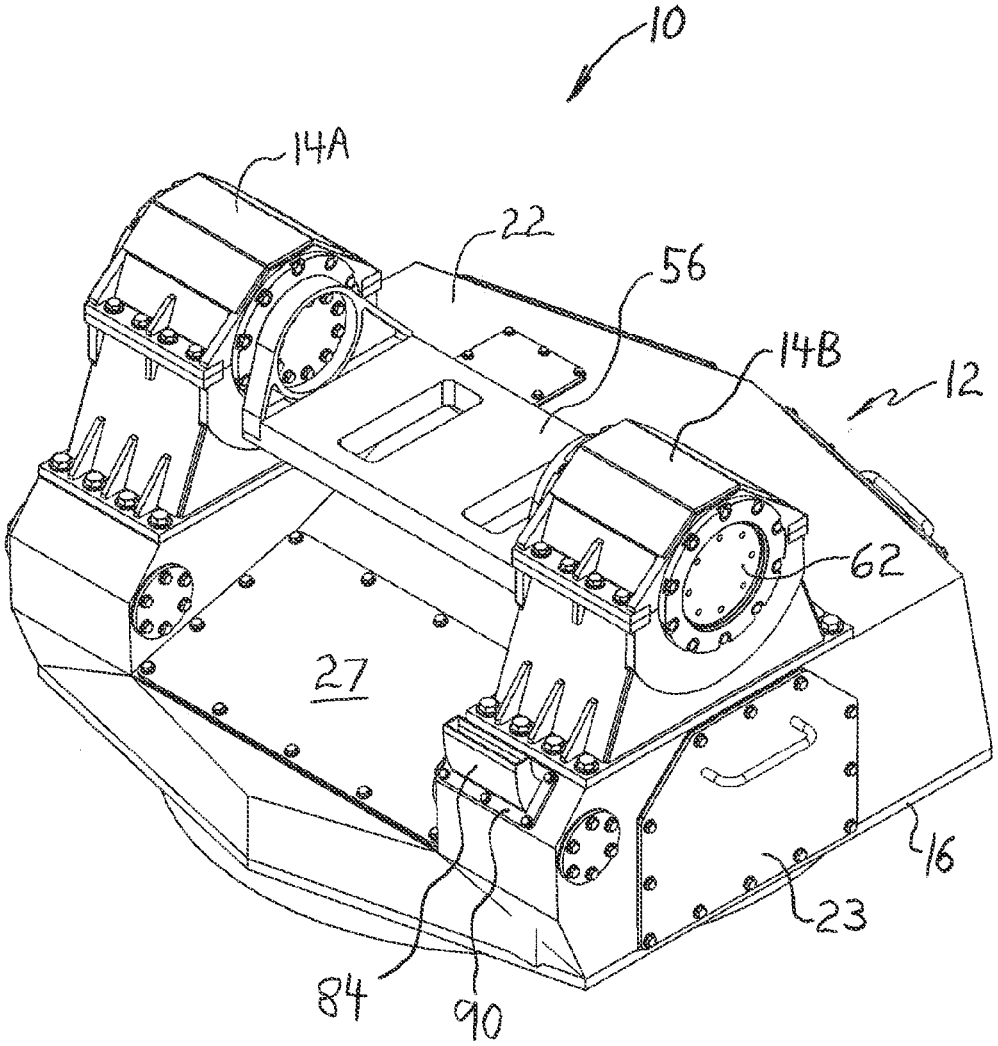
FIG. 2 is another perspective view of the RWS shown in FIG. 1, wherein the RWS is shown equipped with a central weapon cradle.
Figure 3:
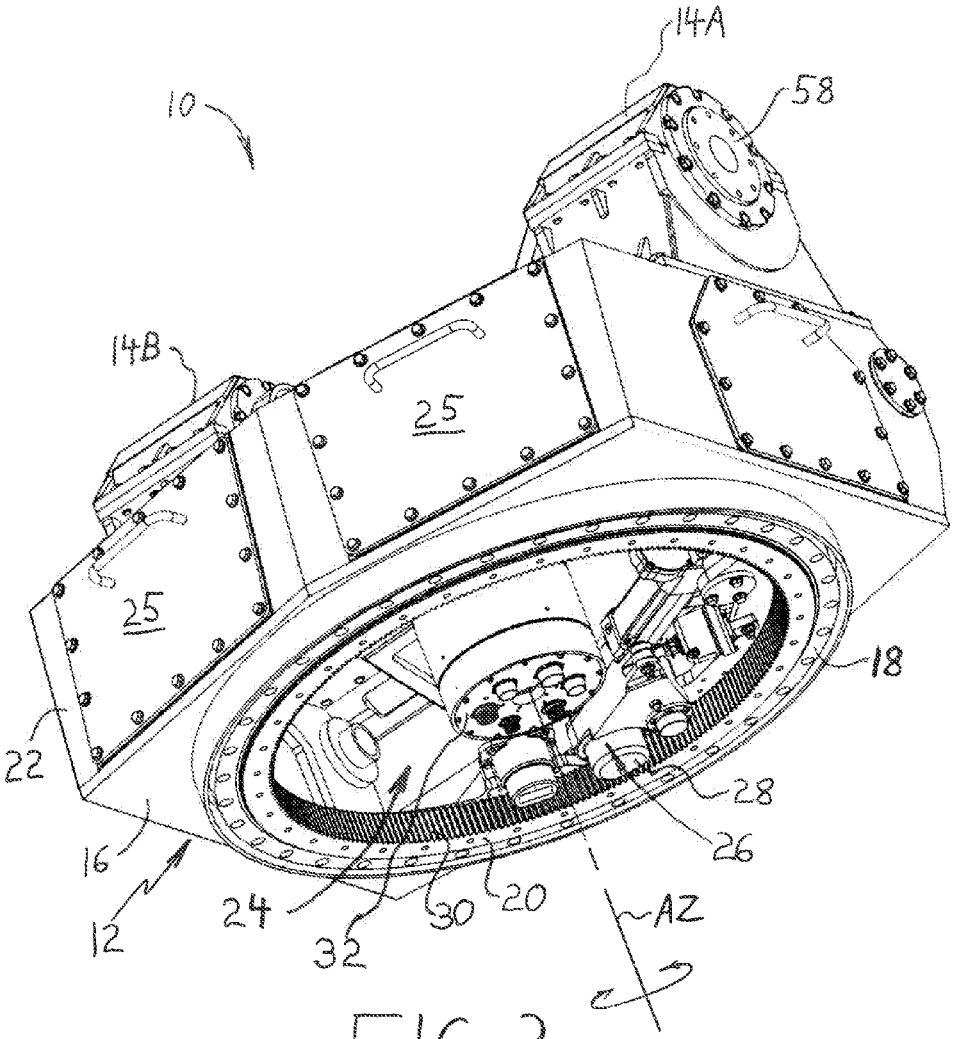
FIG. 3 is a further perspective view of the RWS shown in FIG. 1, viewing from underneath the RWS.

FIGS. 1-4 depict a remote weapon station (RWS) 10 formed in accordance with an embodiment of the present invention, wherein RWS 10 is shown without any weapons, weapon cradles, or other operational units mounted thereon. RWS 10 generally comprises a base or pedestal 12 and a weapon support yoke 14 definable by a first pair of elevation yoke arms 14A, 14B. As will be understood by those skilled in the art, pedestal 12 is adapted to be mounted on an armored vehicle (not shown) so as to cover a hatch opening in a top deck of the armored vehicle and be rotatable relative to the armored vehicle about an azimuth axis AZ. For this purpose, pedestal 12 may include a base plate 16 to which an outer rotary bearing race 18 is attached, and a corresponding inner rotary bearing race 20 mountable to the armored vehicle. For example, inner race 20 may be bolted onto the top deck of the armored vehicle. Pedestal 12 further includes an armored shell 22 coupled to base plate 16. As seen in FIG. 3, pedestal 12 defines an interior compartment 24 that is accessible from within the armored vehicle. Shell 22 may include a pair of lateral hatches 23 at opposite lateral sides of pedestal 12, a pair of front hatches 25 at a front end of the pedestal, and/or a topside hatch 27.

Rotation of pedestal 12 about azimuth axis AZ may be driven by an azimuth drive assembly 26 fixed to an interior wall of shell 22. Azimuth drive assembly 26 includes a motor-driven output gear 28 meshing with inner gear teeth 30 of inner race 20. Azimuth drive assembly 26 may be commanded through an operator interface and control electronics (not shown) to control the angular position of pedestal 12 about azimuth axis AZ relative to the armored vehicle. A slip ring assembly 32 provides signal transmission to and from azimuth drive assembly 26 and other electronic units in pedestal 12 across the rotational interface.

In accordance with an aspect of the present invention, pedestal 12 includes a pair of laterally-spaced yoke arm attachment interfaces 34 for removable mounting of elevation yoke arms 14A, 14B. In the illustrated embodiment, each yoke arm attachment interface 34 includes a flat surface 36 on the exterior of shell 22, a plurality bolt holes 38 registering with bolt holes 40 on the corresponding yoke arm 14A, 14B, and a central opening 42 communicating with pedestal interior compartment 24. The pair of elevation yoke arms 14A, 14B are removably mounted on the pair of yoke arm attachment interfaces 34 using threaded fasteners 44 extending through aligned holes 38, 40. As a result, elevation yoke arms 14A, 14B move with pedestal 12 as the pedestal rotates about azimuth axis AZ. As shown in the depicted embodiment, topside hatch 27 may be located between the pair of yoke arm attachment interfaces 34. RWS 10 includes a pair of elevation rotary bearings 46A, 46B respectively supported by elevation yoke arms 14A, 14B. Elevation rotary bearings 46A, 46B are aligned with each other to define a rotational elevation axis EL at a first height H1 above pedestal 12.

Figure 5:
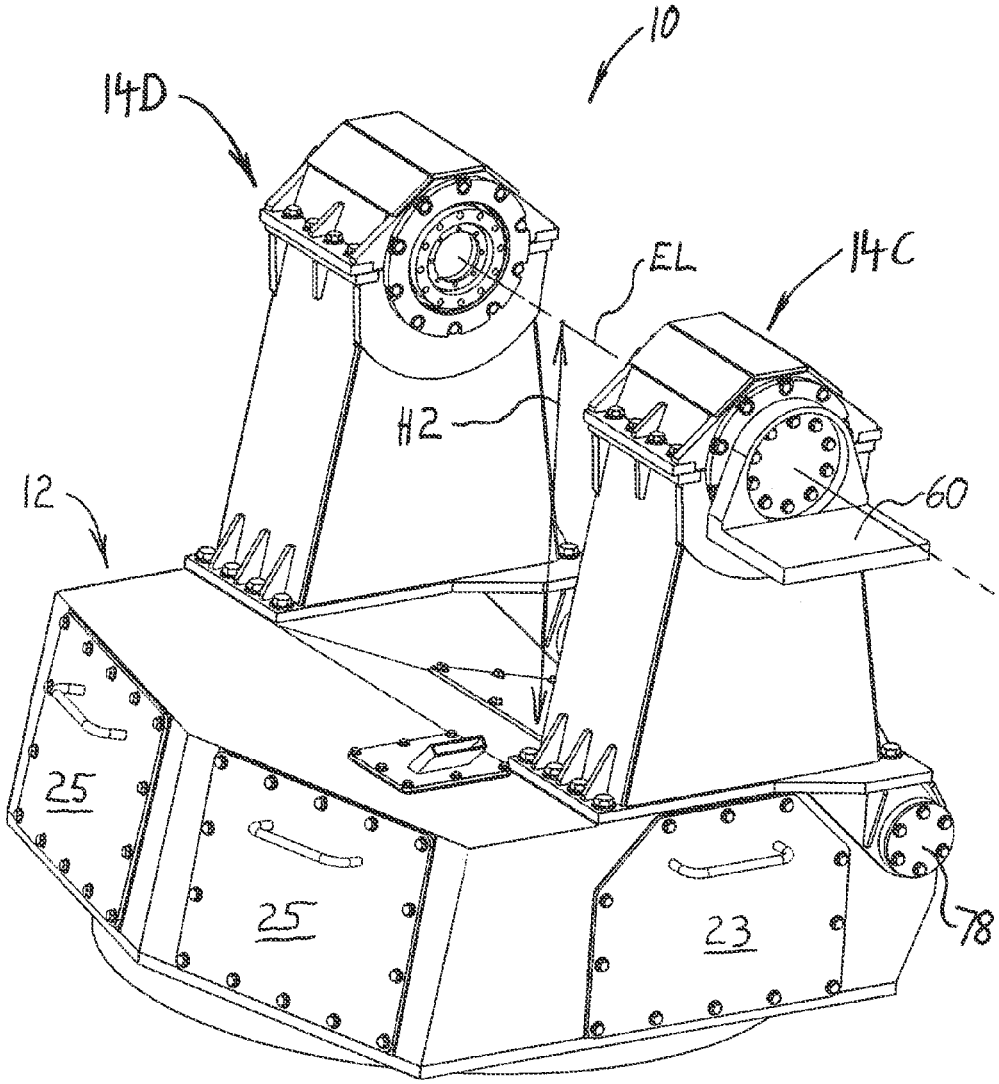
FIG. 5 is a perspective view of the RWS shown in FIG. 1, wherein a first pair of elevation yoke arms of the RWS has been replaced with a second, taller pair of yoke arms, and the RWS is shown equipped with a lateral weapon cradle.
Figure 6:
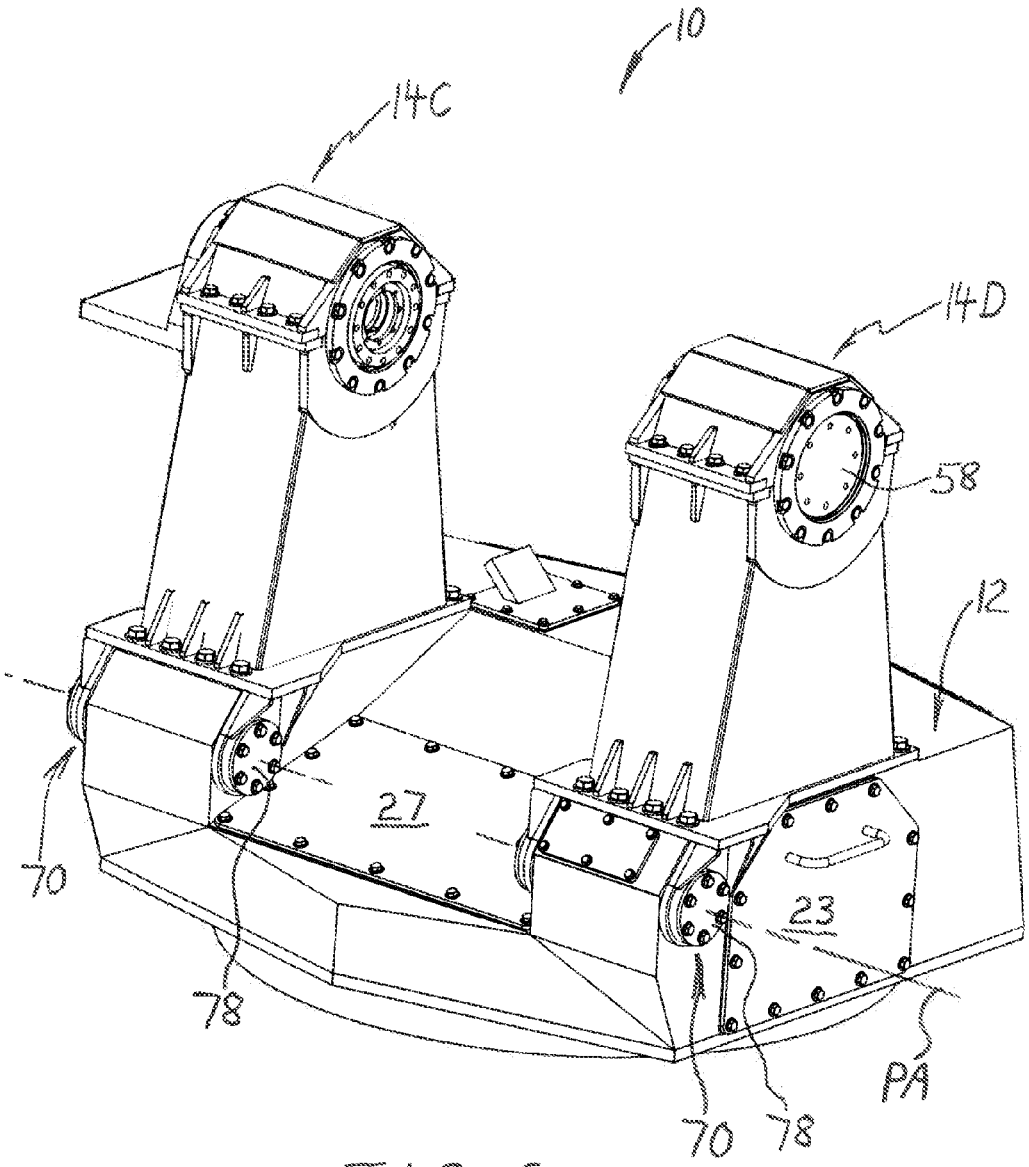
FIG. 6 is another perspective view of the RWS shown in FIG. 5.
Figure 7:
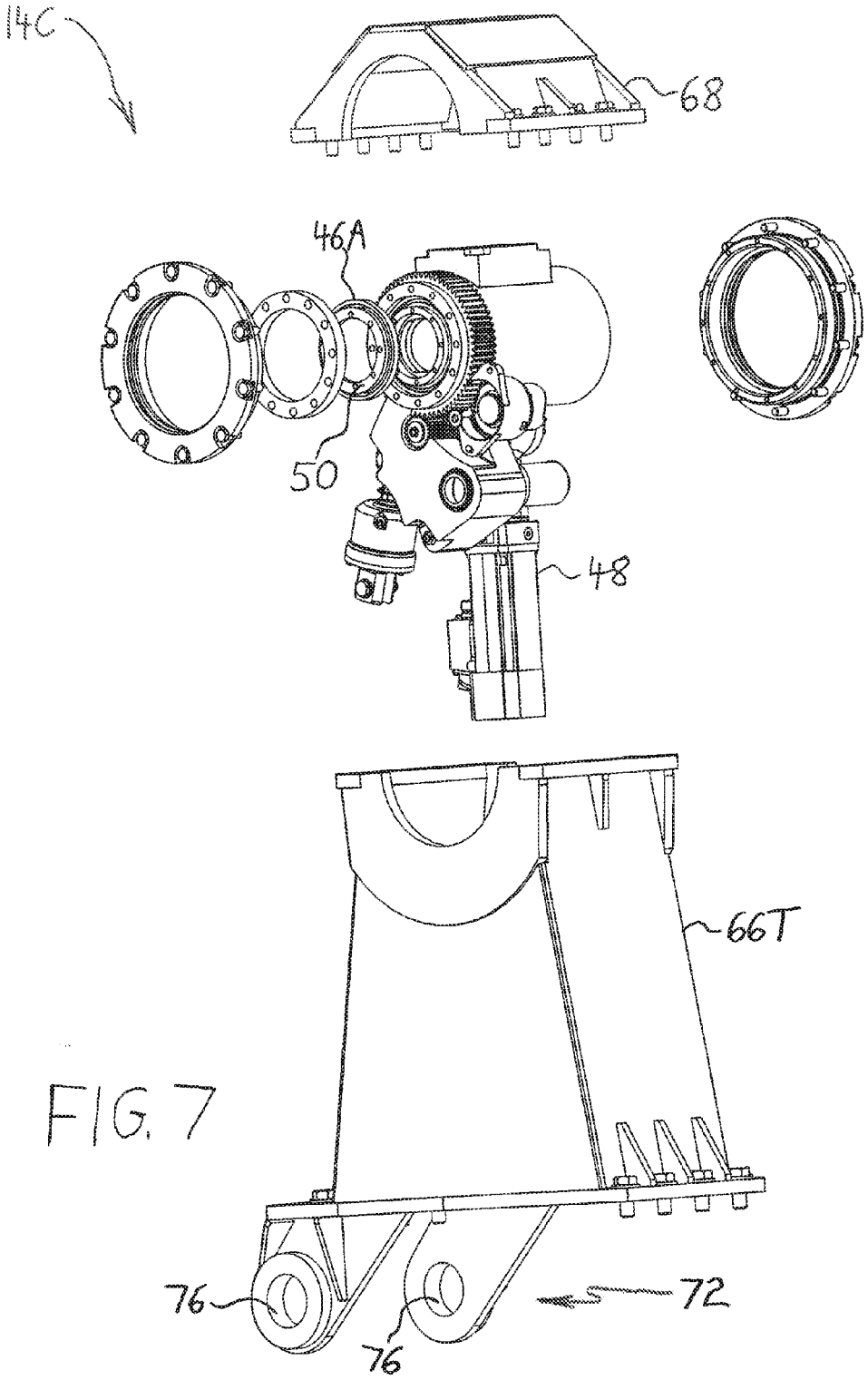
FIG. 7 is an exploded perspective view of an elevation yoke arm of the RWS shown in FIG. 5.

Reference is also made now to FIGS. 5-7. Apparatus for RWS 10 comprises a second pair of elevation yoke arms 14C, 14D configured for removable mounting on the pair of yoke arm attachment interfaces 34 of pedestal 12 for movement with the pedestal. The second pair of elevation yoke arms 14C, 14D are taller than the first pair of yoke arms 14A, 14B and can be selectively swapped with the first pair of elevation yoke arms 14A, 14B to support the pair of elevation rotary bearings 46A, 46B at a second height H2 above the pedestal greater than the first height H1. In this manner, elevation axis EL is height-adjustable for replacing a mounted primary weapon with a different primary weapon.

Figure 4:
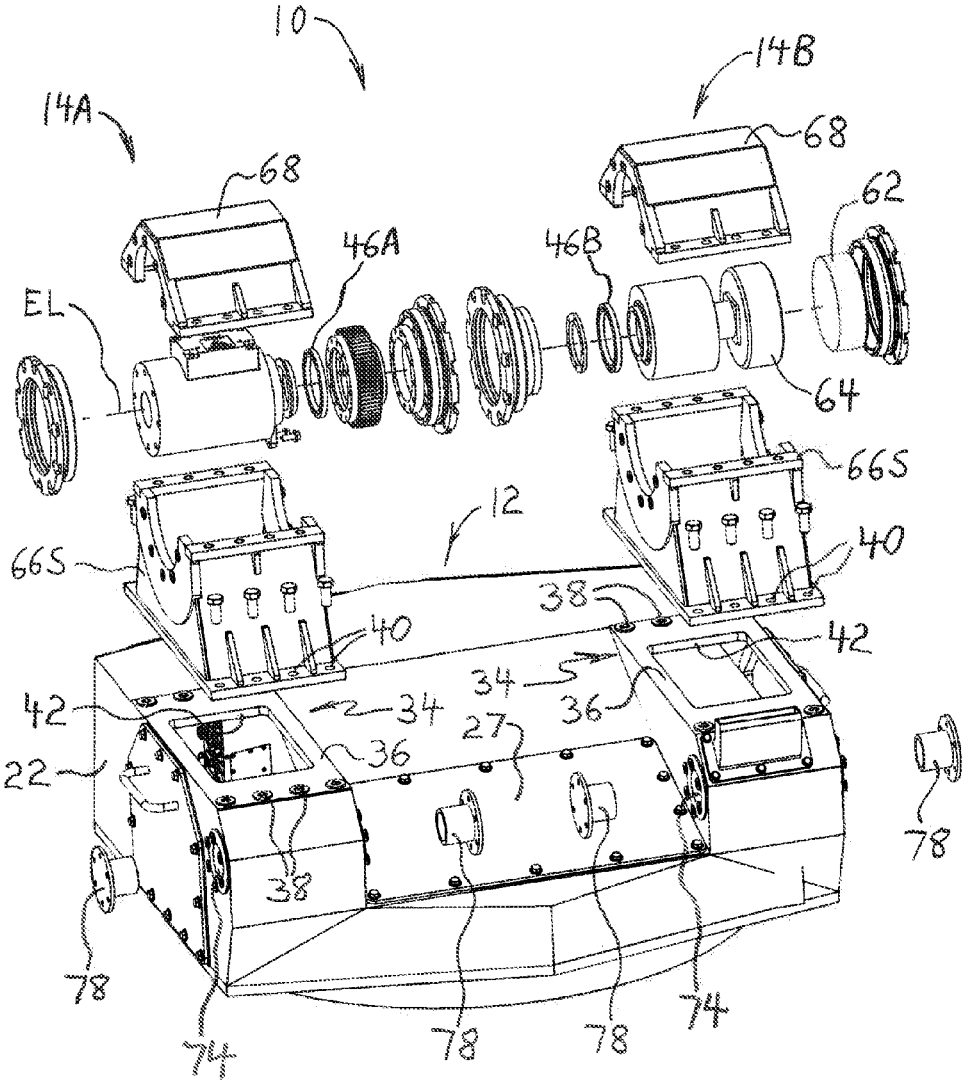
FIG. 4 is an exploded perspective view of the RWS shown in FIG. 1.

As may be understood from FIGS. 4 and 7, RWS 10 additionally comprises an elevation drive motor 48 and an elevation drive hub 50 connected to the elevation drive motor 48 and supported by elevation rotary bearing 46A, wherein elevation drive hub 50 is rotatable about elevation axis EL by operation of elevation drive motor 48. Elevation drive motor 48 may be housed within the elevation yoke arm that houses drive hub 50 to keep drive motor 48 near drive hub 50 and reduce complexity of a connecting drive train assembly, however drive motor 48 may be located outside of the yoke arm without straying from the invention.

RWS 10 also comprises an elevation follower hub 52 supported by elevation rotary bearing 46B. Elevation drive hub 50 and elevation follower hub 52 are configured for removable mounting of at least one primary weapon thereto such that the primary weapon resides between the mounted pair of elevation yoke arms 14A, 14B or 14C, 14D and is rotatable about elevation axis EL by operation elevation drive motor 48. For example, hubs 50 and 52 may each include a bolt hole array used to removably mount a weapon cradle 56 (shown in FIG. 2) or to directly mount a primary weapon housing thereto. Weapon cradle 56 may be designed to support more than one weapon.

RWS 10 may further comprise a lateral hub 58 connected to elevation drive motor 48, wherein the lateral hub 58 is rotatable about elevation axis EL by operation of elevation drive motor 48. Lateral hub 58 is configured for removable mounting of a secondary weapon thereto, either directly or through a secondary or lateral weapon cradle 60, such that the mounted secondary weapon is rotatable about elevation axis EL by operation of the elevation drive motor 48.

Referring again to FIG. 4, RWS 10 may also comprise a sighting hub 62 and a corresponding sighting drive motor 64. In the embodiment shown, sighting hub 62 is supported by the same yoke arm (either 14 B or 14D) as elevation follower hub 52 for rotation about elevation axis EL. Sighting hub 62 is configured for removable mounting of a sighting unit thereto. Sighting hub 62 is rotatable about elevation axis EL by operation of sighting drive motor 64. Sighting drive motor 64 is operable independently of elevation drive motor 48, whereby sighting hub 62 and a mounted sighting unit are rotatable about the elevation axis EL independently of elevation drive hub 50 and any equipment or weapons mounted to drive hub 50.

Attention is now directed to FIGS. 4 and 7. In an aspect of the present invention, the second pair of elevation yoke arms 14C, 14D may be structurally similar to the first pair of elevation yoke arms 14A, 14B. When mounted to pedestal 12, each yoke arm 14A-14D includes a respective base 66S or 66T and a respective cap 68 removably attachable onto base 66. In the embodiment shown by the figures, the yoke arm bases 66T (tall) of the second pair of elevation yoke arms 14C, 14D are taller than the yoke arm bases 66S (short) of the first pair of elevation yoke arms 14A, 14B. Each base 66S or 66T is adapted for removable mounting to one of the yoke arm attachment interfaces 34 of pedestal 12. For example, each yoke arm base 66S or 66T may include bolt holes 40 registering with the bolt holes 38 of an associated yoke arm attachment interface 34. Caps 68 for yoke arms 14C, 14D may be identical to caps 68 for yoke arms 14A, 14B, or at least they may fit onto yoke arms 14A, 14B. Thus, the overall apparatus may require only a single pair of caps 68 for installation on the two bases 66 of the particular pair of yoke arms that currently mounted on pedestal 12 at a given time; the yoke arm bases 66S or 66T not in use at a given time do not require caps 68.

When RWS 10 is configured with taller yoke arms 14C, 14D, the overall height of the armored vehicle may prevent it from passing through locations where there are overhead obstructions. In order to temporarily lower the overall profile height of the armored vehicle, pedestal 12 may further include a pair of yoke arm pivot interfaces 70 spaced from the pair of yoke arm attachment interfaces 34, and the yoke arm bases 66T of the second pair of yoke arms 14C, 14D may include a pivot coupling 72 configured to mate with a corresponding pivot interface 70 of pedestal 12. For example, pivot interfaces 70 may have a pair of aligned circular pivot apertures 74 with which another pair of pivot apertures 76 in base 66T may be aligned, and a pair of pivot covers 78 securable into the aligned pivot apertures 74, 76. As a result, the second pair of yoke arms 14C, 14D may be pivoted relative to pedestal 12 when they are situated on, but not fixed to, yoke arm attachment interfaces 34. In this way, the armored vehicle can be provided with a lower profile for travel. The yoke arm pivot interfaces 70 may define a yoke arm pivot axis PA parallel to and behind elevation axis EL.

Changeover between the first pair of yoke arms 14A, 14B and the second pair of yoke arms 14C, 14D may be carried out by unbolting yoke arm caps 68 from the mounted yoke arm bases, removing the assembled bearings, hubs, and any drive motors housed by the mounted yoke arms, and unbolting the mounted yoke arm bases 66 from yoke arm attachment interfaces 34. The yoke arm bases 66 of the other pair of yoke arms are then bolted to the yoke arm attachment interfaces 34, the drive assemblies are reinstalled and aligned in the newly mounted yoke arm bases 66, and the caps 68 are bolted onto the newly mounted yoke arm bases 66. Transferring the same drive assemblies and bearings between the short and tall yoke arms avoids hardware cost and reduces the amount of additional hardware that must be stocked. It is also contemplated to provide dedicated drive assemblies within each yoke arm 14A-14D so that removal and replacement of the drive assemblies is not necessary. As will be appreciated, changeover may be accomplished quickly by trained mechanics at a military base, whereby the same armored vehicle may have one RWS configuration one day and a different RWS configuration the next.

Figure 8:
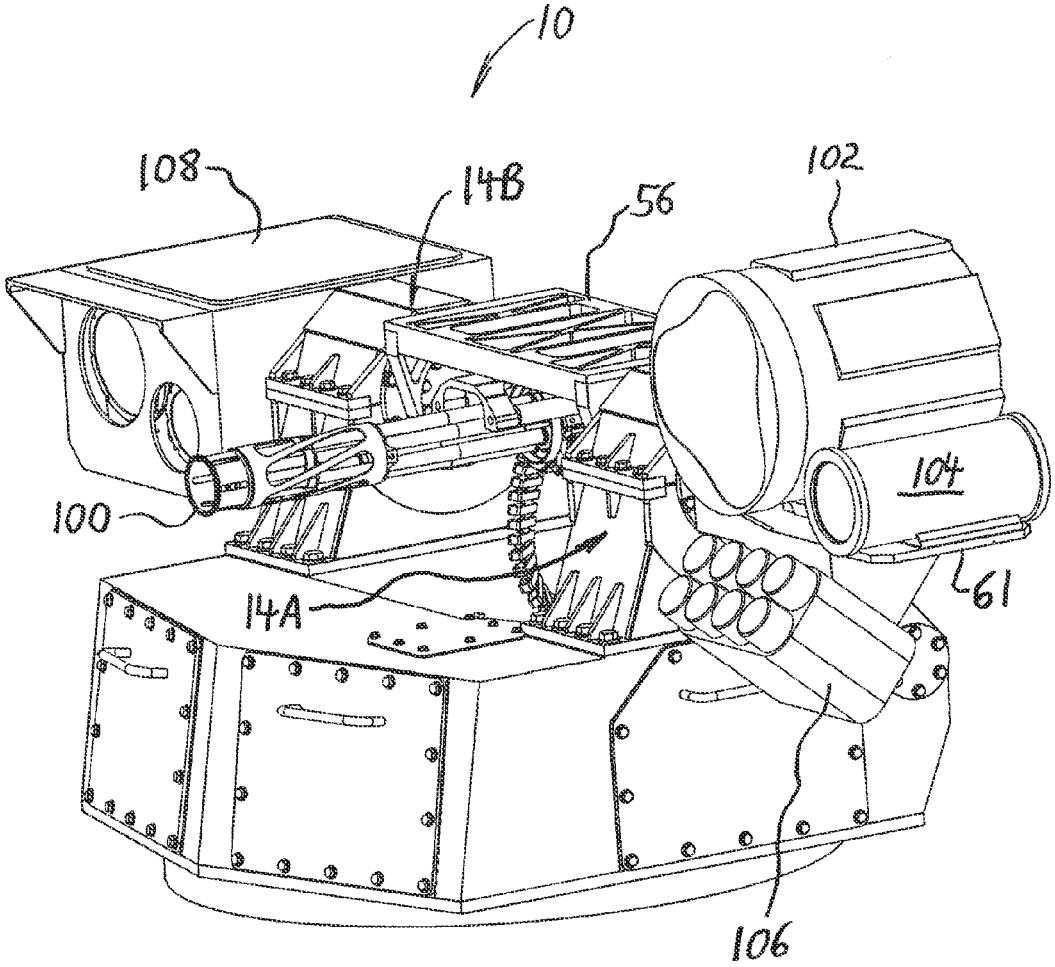
FIGS. 8-10 depict examples of various weapon configurations of the RWS as shown in FIG. 1, wherein shorter yoke arms are installed.
Figure 9:
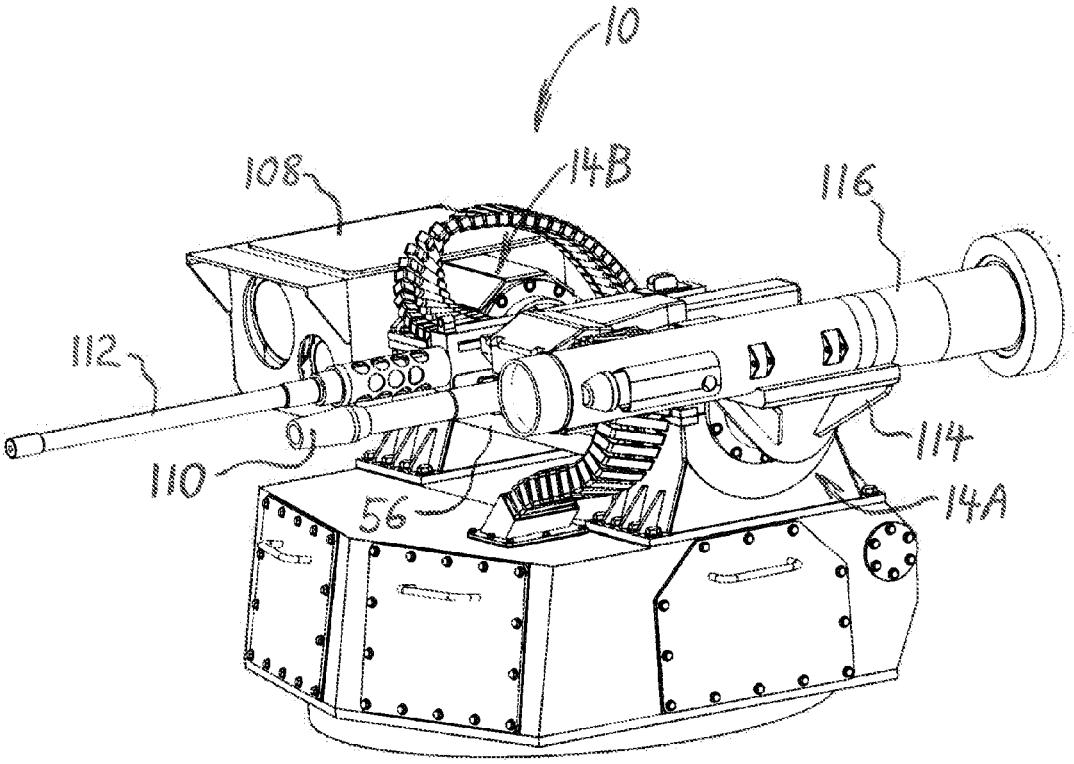
Figure 10:
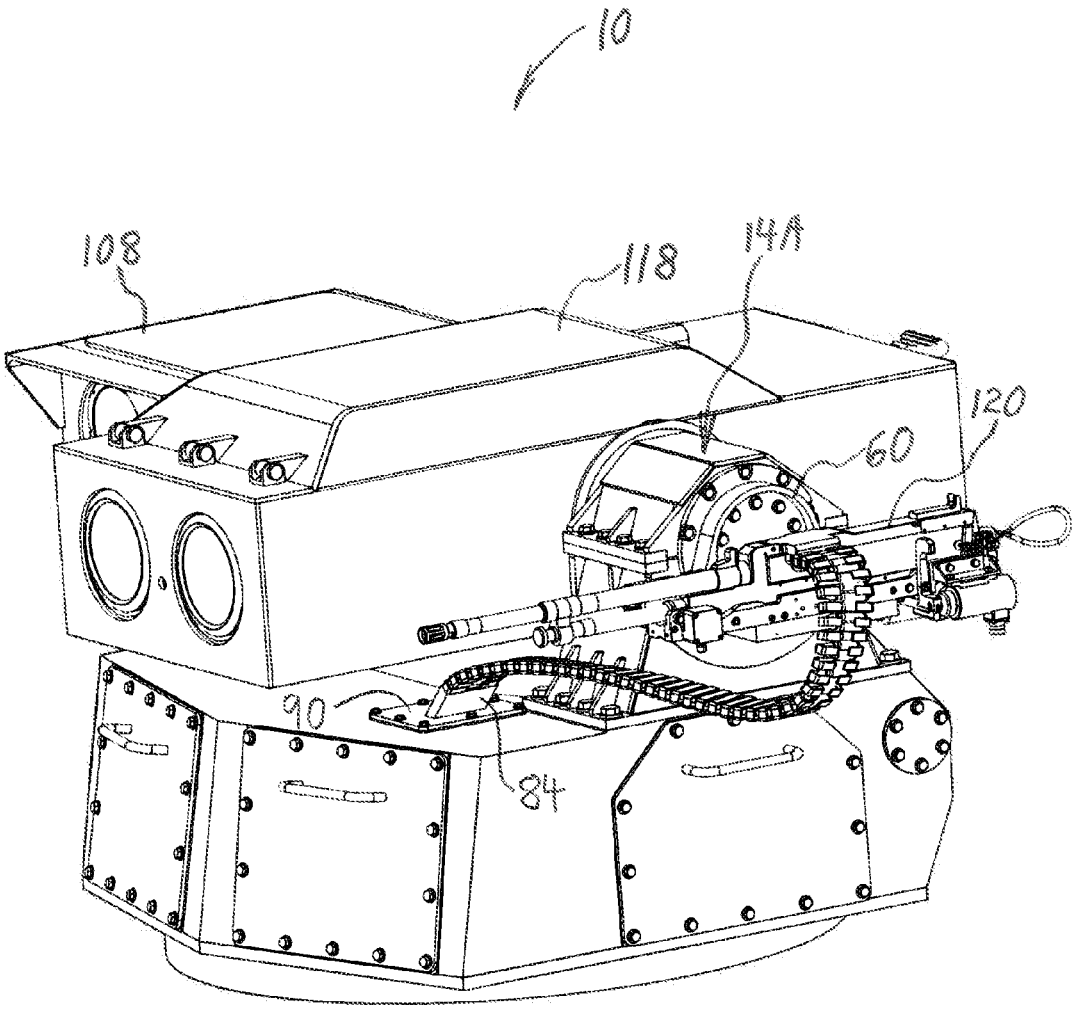

FIGS. 8-10 illustrate various examples of weapon configurations of RWS 10 when the shorter pair of yoke arms 14A, 14B is installed on pedestal 12.

In FIG. 8, there is central weapon cradle 56 mounted between drive hub 50 and follower hub 52, and an M134 machine gun 100 mounted on central weapon cradle 56 as a primary weapon. A non-lethal equipment cradle 61 is coupled to lateral hub 58 and carries an acoustic hailer 102, an illuminator 104, and a grenade launcher 106. A sighting unit 108 is mounted on the opposite side of the RWS to sighting hub 62.

The configuration shown in FIG. 9 includes central weapon cradle 56 mounted between drive hub 50 and follower hub 52 to support an MK19 automatic grenade launcher 110 and an M2 machine gun 112. A javelin mount 114 is attached to lateral hub 58 and supports a javelin missile launcher 116. Sighting unit 108 is mounted on sighting hub 62.

In FIG. 10, a TOW missile launcher 118 has a hub bracket for direct mounting to drive hub 50 and follower hub 52. Lateral cradle 60 supports an M240 machine gun 120. Sighting unit 108 is mounted on sighting hub 62.

FIGS. 11-14 show examples of other weapon configurations of RWS 10 when the taller pair of yoke arms 14C, 14D is installed on pedestal 12 replacing shorter yoke arms 14A, 14B.

Figure 11:
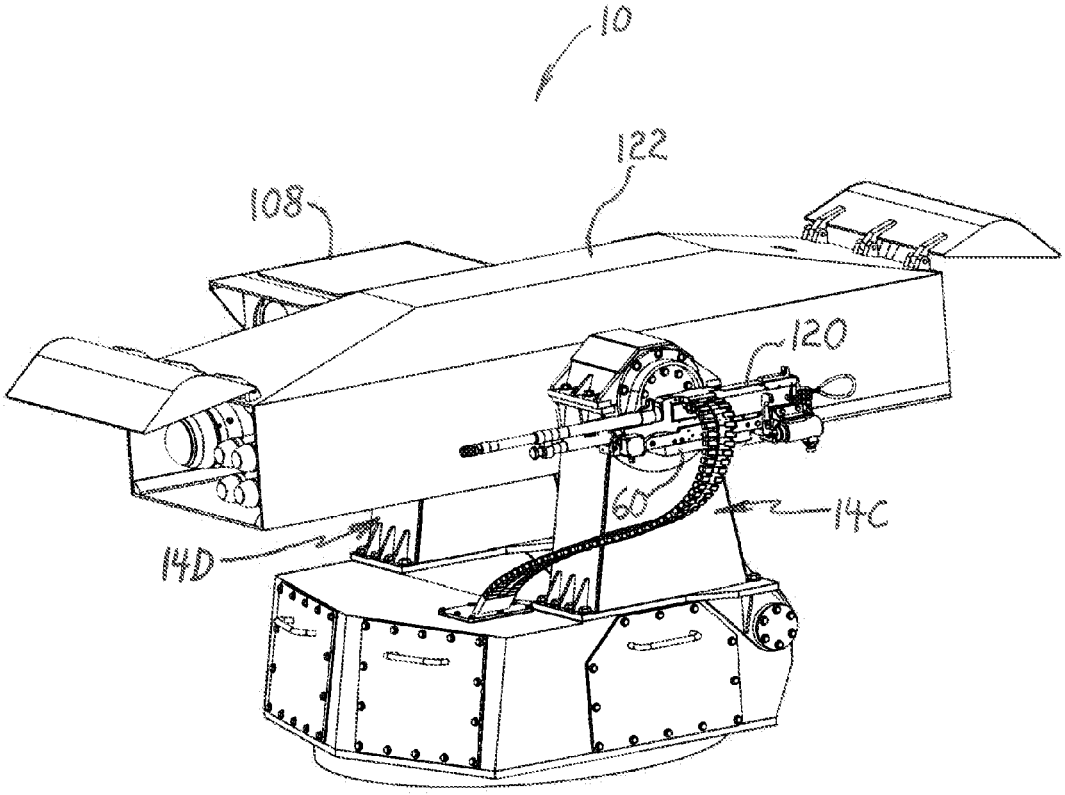
FIGS. 11-14 depict examples of various weapon configurations of the RWS as shown in FIG. 5, wherein taller yoke arms are installed.

In FIG. 11, a hellfire missile launch pod 122 has a hub bracket for direct mounting to drive hub 50 and follower hub 52. Lateral cradle 60 supports M240 machine gun 120. Again, sighting unit 108 is mounted on sighting hub 62.

Figure 12:
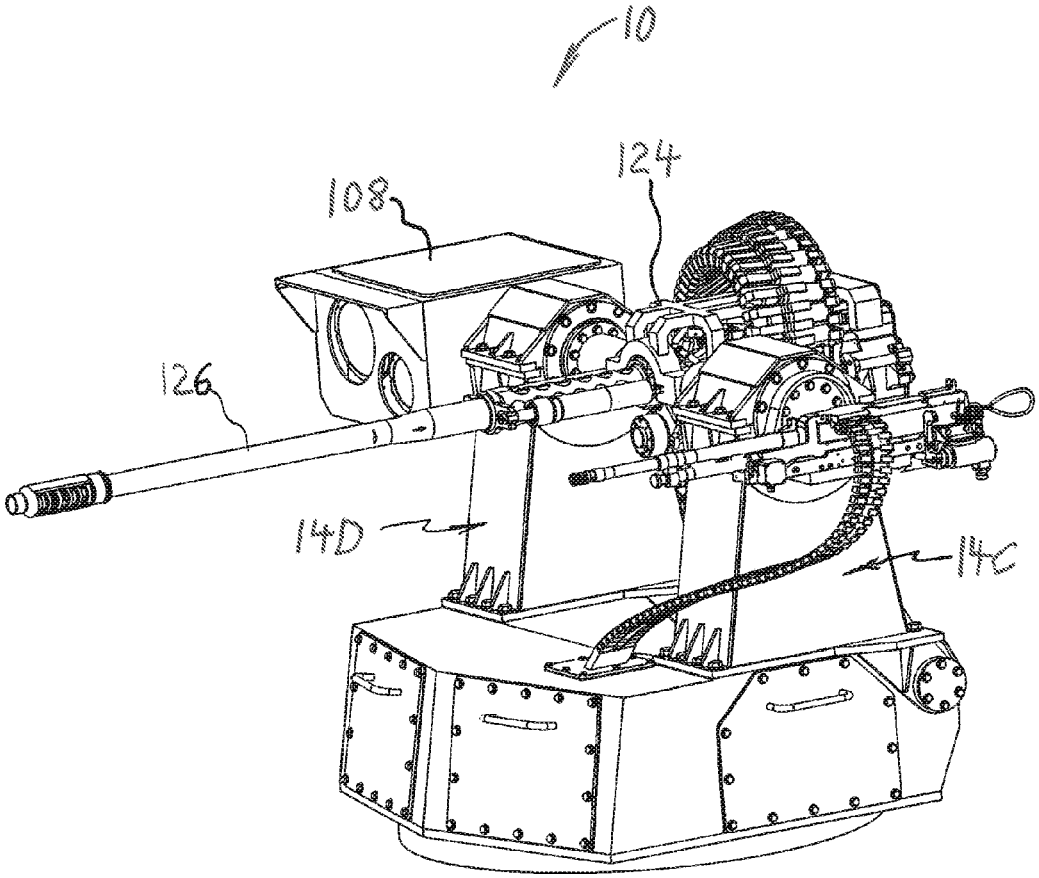

The configuration of FIG. 12 is similar to that of FIG. 11, except the hellfire pod is replaced by an M230LF cradle 124 coupled to hubs 50 and 52 that carries an M230LF autocannon 126.

Figure 13:
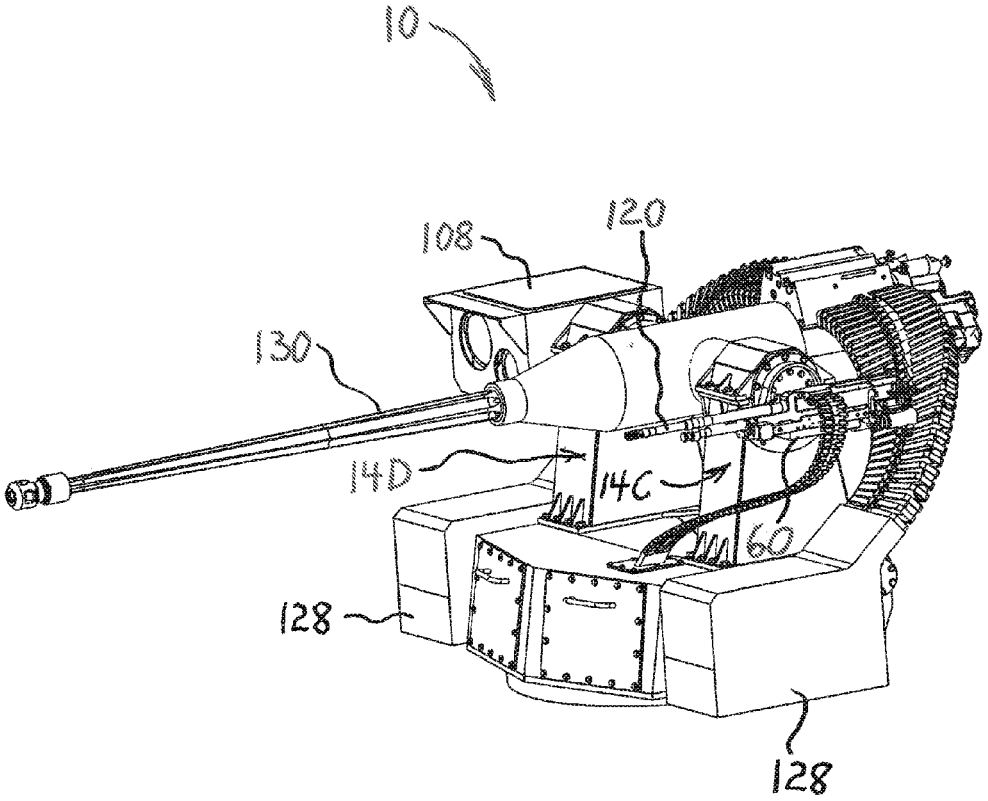

In FIG. 13, a pair of 30 mm ammunition boxes 128 are associated with opposite lateral sides of RWS 10, and an MK44 chain gun assembly 130 is mounted to hubs 50 and 52 as the primary weapon. Lateral cradle 60 supports M240 machine gun 120, and sighting unit 108 is mounted on sighting hub 62.

Figure 14:
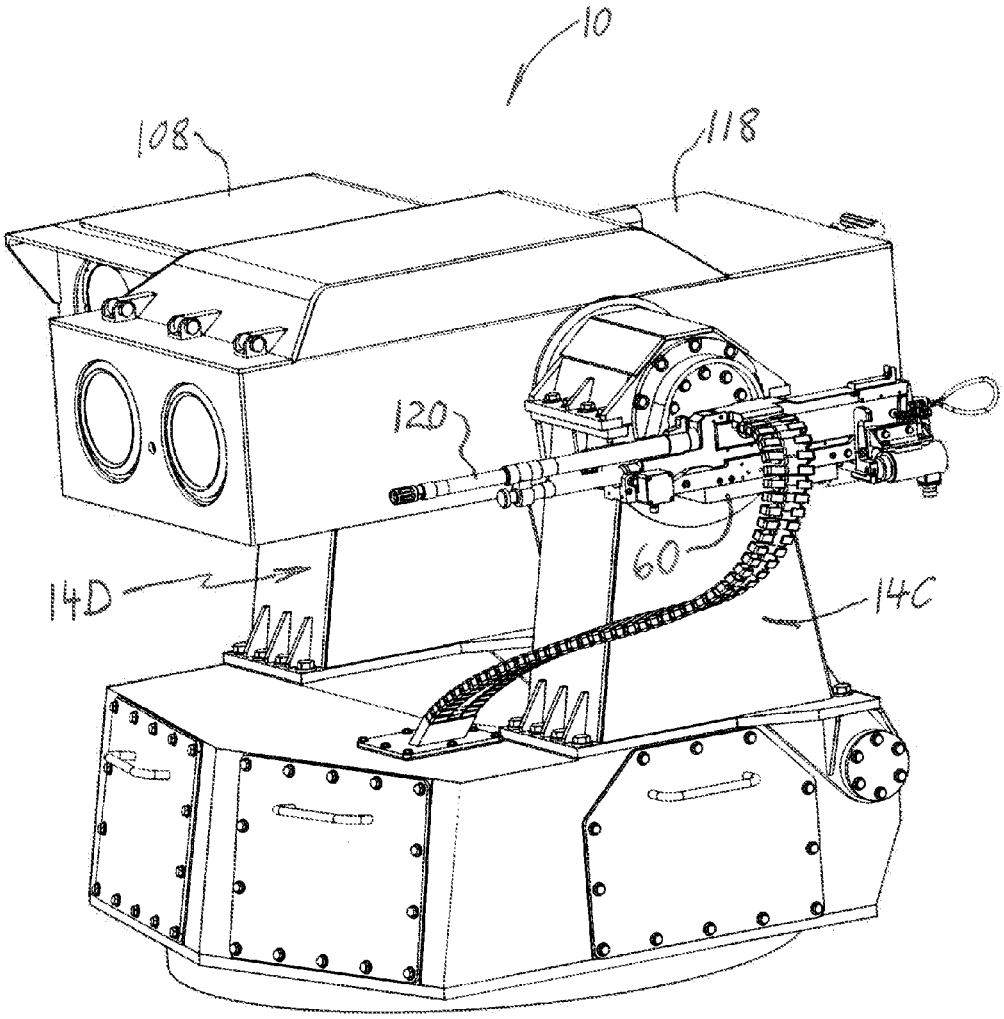
Figure 15:
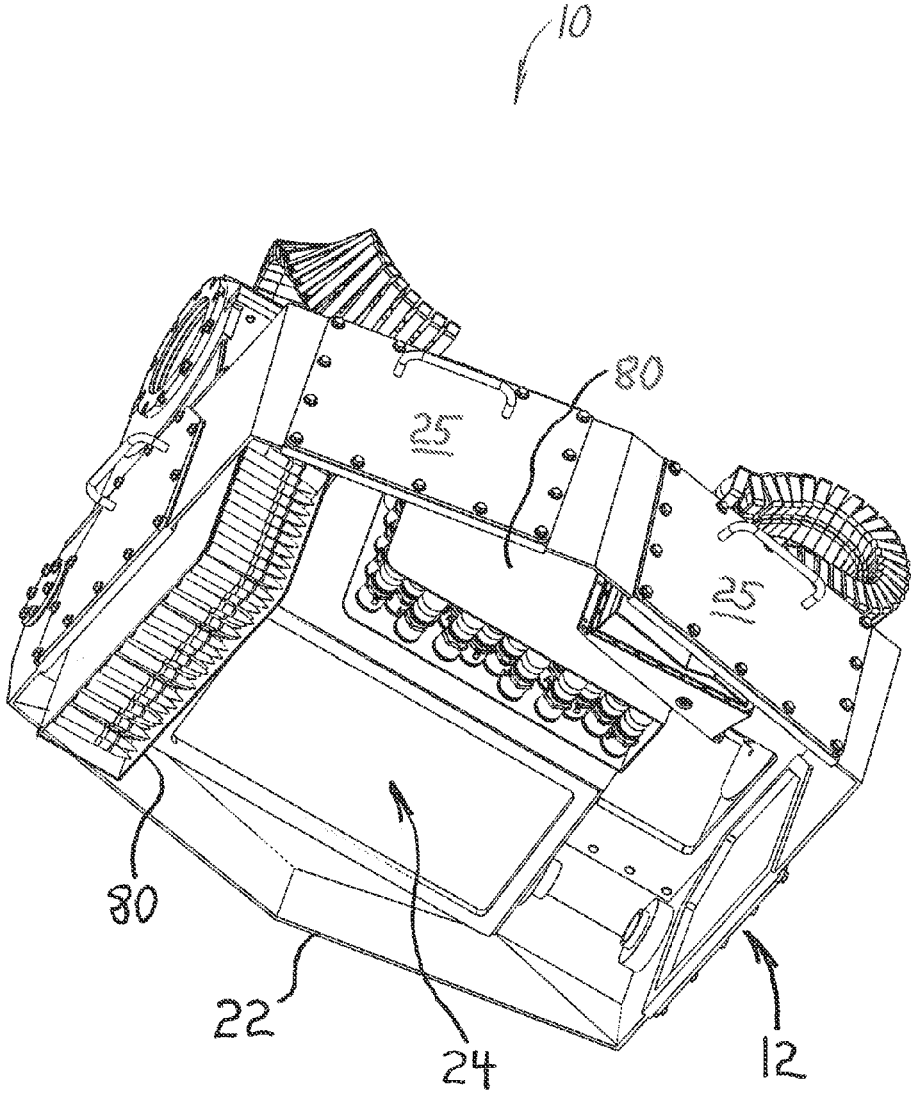
FIG. 15 is a perspective view looking upward toward an inner compartment of the RWS pedestal, wherein a base plate of the pedestal and other structure are hidden to more clearly show ammunition containers of the RWS.
Figure 16:
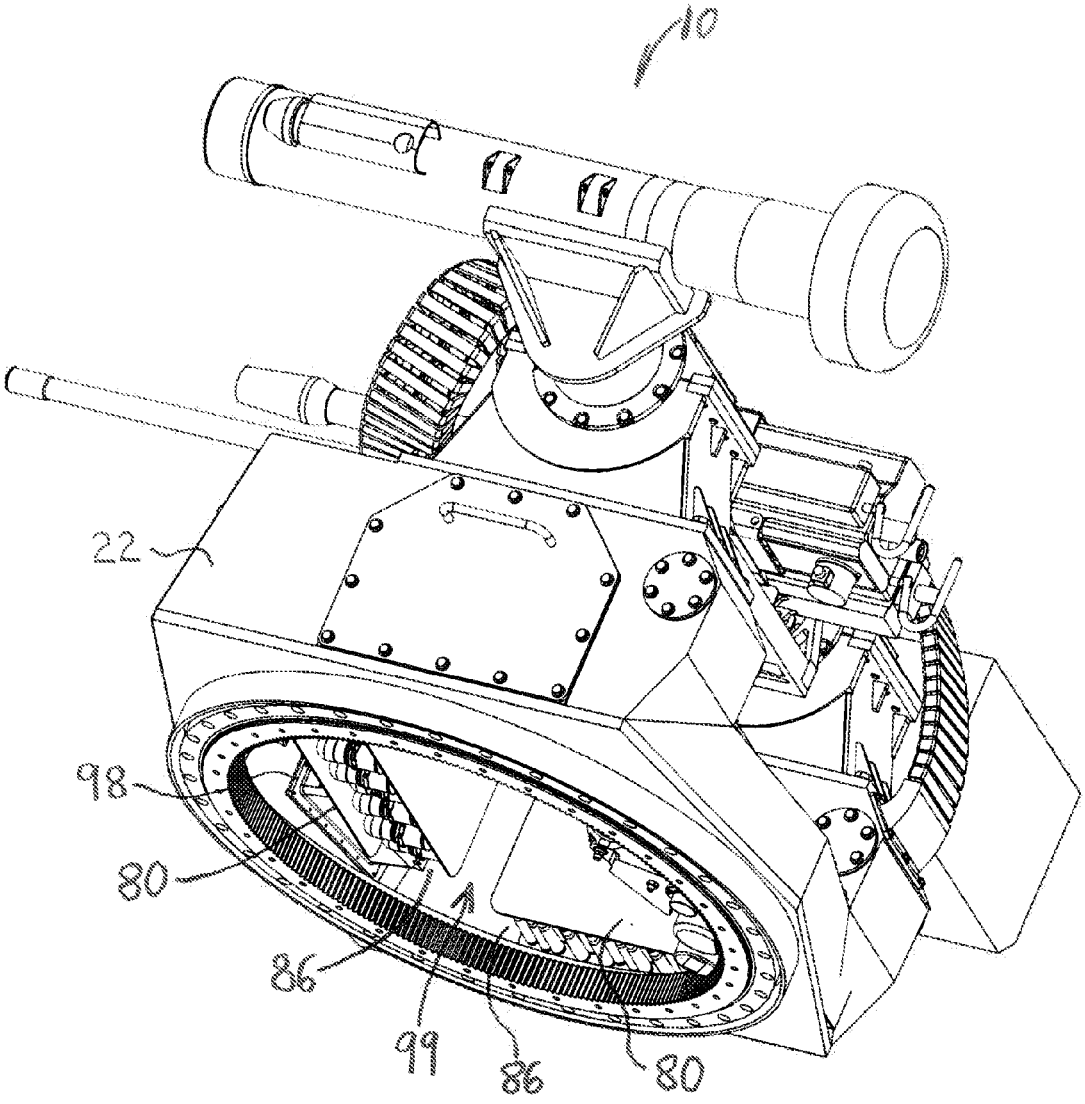
FIG. 16 is another perspective view looking upward toward an inner compartment of the RWS pedestal, wherein a slip ring of the RWS is hidden to more clearly show ammunition containers of the RWS.
Figure 17:
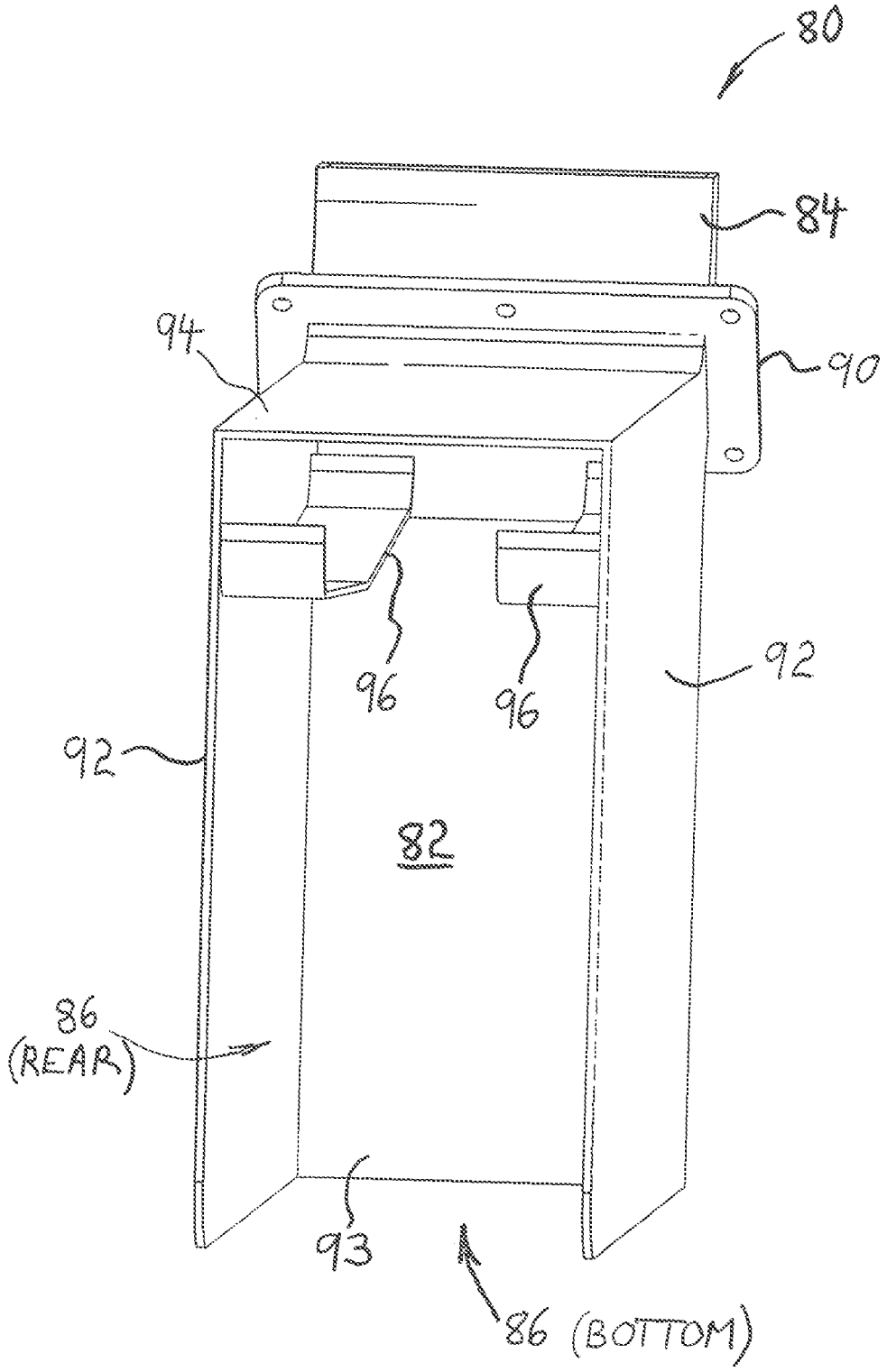
FIG. 17 is a perspective view of an empty ammunition container of the RWS.

FIG. 14 shows TOW missile launcher 118 directly mounted to hubs 50 and 52 as the primary weapon. Lateral cradle 60 supports M240 machine gun 120, and sighting unit 108 is mounted on sighting hub 62.

The configurations shown in FIGS. 8 through 14 are intended as non-limiting examples. Of course, many other configurations involving other weapons and equipment are possible.

In another aspect of the present invention, RWS 10 enables reloading of ammunition under the armored protection of the vehicle and pedestal 12 without using space within the vehicle compartment and without the need for a conveyor mechanism. As best seen in FIGS. 15-18, RWS 10 comprises an ammunition container 80 having an ammunition storage portion 82 and an ammunition exit chute 84 leading from the storage portion 82, wherein the ammunition container 80 is fixed to pedestal 12 such that its storage portion 82 resides completely within interior compartment 24 of pedestal 12 and its exit chute 84 extends through shell 22 of pedestal 12. While it is preferred that storage portion 82 fit completely within interior compartment 24, an alternative wherein storage portion 82 is mostly within interior compartment 24 is also contemplated. Storage portion 82 of ammunition container 80 has a reload opening 86 by which the ammunition container may be reloaded with ammunition. A belt 88 of linked ammunition is fed from storage portion 82 through exit chute 84 to supply a weapon carried by the weapon support yoke 14, and the ammunition container is reloadable by onboard personnel under protection of the armored vehicle and the pedestal.

Ammunition container 80 may include a flange 90 on exit chute 84, whereby the ammunition container 80 may be fixed to shell 22 of pedestal 12 by threaded fasteners engaging the flange and the pedestal.

Figure 18:
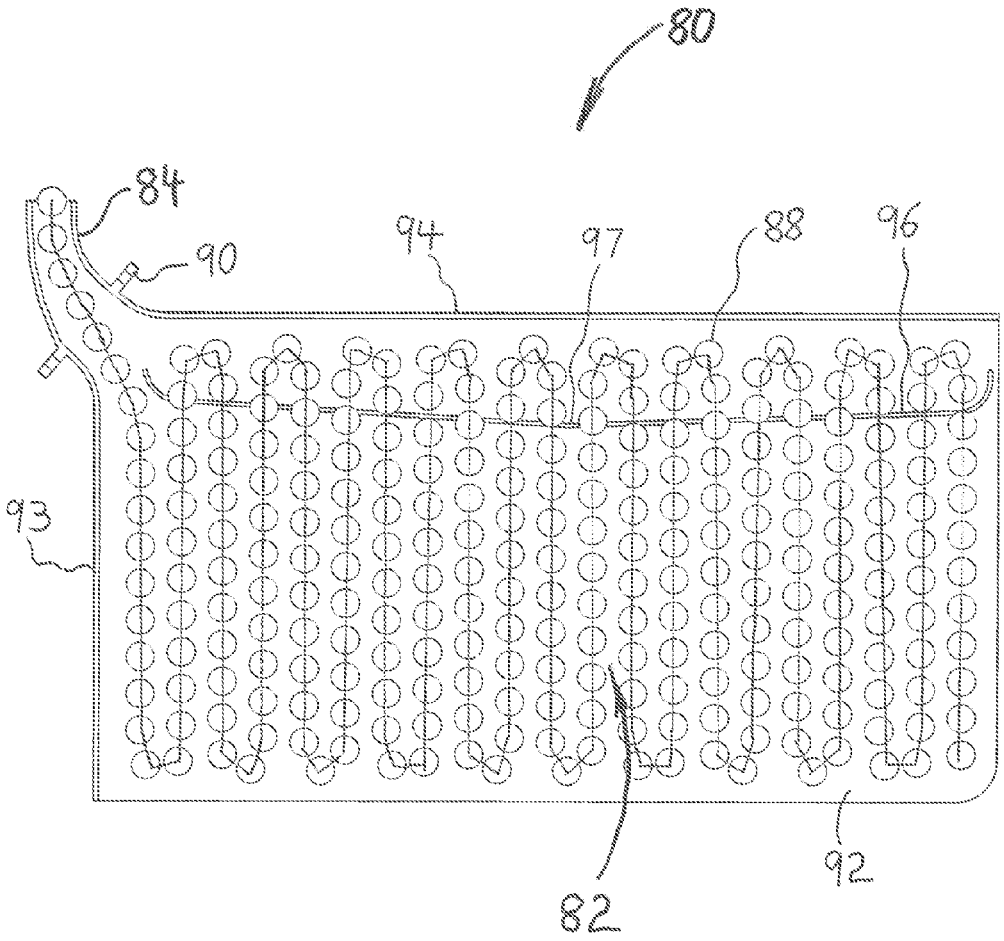
FIG. 18 is a cross-sectional view of the ammunition container shown in FIG. 17, wherein the ammunition container is loaded with an ammunition belt.

The storage portion 82 of ammunition container 80 may have a pair of side walls 92 connected by a front wall 93 and a top wall 94, wherein at least one of a bottom and a rear of storage portion 82 is open to provide the reload opening 86. Ammunition container 80 may take the form of a "hanging ammo" container configured with an open rear and a pair of inner support ledges 96 extending from side walls 92 to receive and suspend a folded ammunition belt 88 that is slid into the container through the rear reload opening 86. In the depicted embodiment, both the bottom and the rear of storage portion 82 are open to provide the reload opening 86, thereby allowing greater access during reloading. As best seen in FIG. 18, ledges 96 may have a slight dip or trough 97 to prevent unwanted sliding or shifting of the suspended ammunition belt 88 as the vehicle travels over uneven terrain. Support ledges 96 may be omitted if they would impede the feeding of a particular size of ammunition round.

As will be understood from the drawing figures, weapon support yoke 14 may be configured to support two weapons and RWS may comprise two ammunition containers 80 respectively associated with the two weapons. Those skilled in the art will understand that the dimensions and specific configuration of each ammunition container 80 may vary and will depend on the specific type of ammunition being fed.

To allow an operator to reload either or both of the containers 80 from the same location, and to simplify location of a firing control unit 98 sensing ammunition status, the respective reload openings 86 of the two ammunition containers 80 may face a common reloading space 99 within interior compartment 24.

While the invention has been described in connection with exemplary embodiments, the detailed description is not intended to limit the scope of the invention to the particular forms set forth. The invention is intended to cover such alternatives, modifications and equivalents of the described embodiment as may be included within the spirit and scope of the invention.

What is claimed is:

1. A remote weapon station comprising:

an armored pedestal adapted to be mounted on an armored vehicle, wherein the pedestal is rotatable about an azimuth axis relative to the armored vehicle and the pedestal defines an interior compartment accessible from within the armored vehicle;

a weapon support yoke mounted on an exterior of the pedestal;

an ammunition container having an ammunition storage portion and an ammunition exit chute leading from the storage portion, wherein the ammunition container is fixed to the pedestal such that the storage portion of the ammunition container resides at least mostly within the interior compartment of the pedestal and the exit chute of the ammunition container extends through the pedestal, the storage portion of the ammunition container having a reload opening by which the ammunition container may be reloaded with ammunition;

wherein the ammunition container is fixed to the pedestal such that the storage portion of the ammunition container is immovably suspended at a permanent location within the interior compartment of the pedestal;

whereby a belt of linked ammunition is fed from the storage portion through the exit chute to supply a weapon carried by the weapon support yoke, and the ammunition container is reloadable by personnel under protection of the armored vehicle and the pedestal;

wherein the ammunition container is reloadable, and the weapon is able to be fired and supplied with ammunition from the ammunition container, while the ammunition container is at the permanent location.

2. The remote weapon station according to claim 1, wherein the storage portion of the ammunition container resides completely within the interior compartment of the pedestal.

3. The remote weapon station according to claim 1, wherein the ammunition container further includes a flange on the exit chute, and the ammunition container is immovably suspended from the pedestal by threaded fasteners engaging the flange and the pedestal.

4. The remote weapon station according to claim 1, wherein the storage portion of the ammunition container has a pair of side walls connected by a front wall and a top wall, and wherein a bottom of the storage portion is open to provide the reload opening.

5. The remote weapon station according to claim 4, wherein both the bottom and a rear of the storage portion are open to provide the reload opening.

6. The remote weapon station according to claim 1, wherein the weapon support yoke is configured to support two weapons and the remote weapon station comprises two ammunition containers respectively associated with the two weapons, and wherein the respective reload openings of the two ammunition containers face a common reloading space between the two ammunition containers within the interior compartment.

7. A weapon station apparatus comprising:

a pedestal adapted to be mounted on an armored vehicle for rotation relative to the armored vehicle about an azimuth axis, the pedestal including a pair of laterally-spaced yoke arm attachment interfaces;

a pair of elevation yoke arms configured for removable mounting on the pair of yoke arm attachment interfaces of the pedestal for movement with the pedestal;

a pair of elevation rotary bearings respectively supported by the pair of elevation yoke arms, the pair of elevation rotary bearings being aligned with each other to define a rotational elevation axis, the pair of yoke arms being configured for supporting a weapon therebetween for rotation about the elevation axis;

wherein each of the pair of elevation yoke arms includes a respective yoke arm base adapted for removable mounting to one of the yoke arm attachment interfaces of the pedestal;

wherein the pedestal further includes a pair of yoke arm pivot interfaces spaced from the pair of yoke arm attachment interfaces, and wherein the yoke arm bases of the pair of yoke arms are further adapted for pivotal mounting to the pair of yoke arm pivot interfaces of the pedestal, whereby the pair of yoke arms is pivotable relative to the pedestal when the pair of yoke arms is situated on but not fixedly attached to the pedestal.

8. The apparatus according to claim 7, wherein the pair of yoke arm pivot interfaces define a yoke arm pivot axis parallel to the elevation axis.

9. The apparatus according to claim 8, wherein the yoke arm pivot axis is behind the elevation axis.

* * * * *